US007934386B2

(12) United States Patent
Rummel et al.

(10) Patent No.: US 7,934,386 B2
(45) Date of Patent: May 3, 2011

(54) SYSTEM AND METHOD FOR COOLING A HEAT GENERATING STRUCTURE

(75) Inventors: Kerrin A. Rummel, Richardson, TX (US); Kevin W. Chen, McKinney, TX (US)

(73) Assignee: Raytheon Company, Waltham, MA (US)

( * ) Notice: Subject to any disclaimer, the term of this patent is extended or adjusted under 35 U.S.C. 154(b) by 553 days.

(21) Appl. No.: 12/036,468

(22) Filed: Feb. 25, 2008

(65) Prior Publication Data

US 2009/0211277 A1 Aug. 27, 2009

(51) Int. Cl.
*F25D 17/02* (2006.01)

(52) U.S. Cl. ..... 62/118; 62/259.2; 62/527

(58) Field of Classification Search ..... 62/113, 62/118, 207, 208, 524, 527, 528, 259.2; 165/104.22, 165/104.28

See application file for complete search history.

(56) References Cited

U.S. PATENT DOCUMENTS

| | | | | |
|---|---|---|---|---|
| 1,528,619 | A | 3/1925 | Alphonse | |
| 1,906,422 | A | 5/1933 | Roulton | |
| 2,321,964 | A | 6/1943 | Zieber | |
| 2,371,443 | A | 3/1945 | Harold | |
| 2,991,978 | A | 7/1961 | Jones | |
| 3,131,548 | A | 5/1964 | Chubb et al. | |
| 3,174,540 | A | 3/1965 | Dutton | |
| 3,332,435 | A | 7/1967 | Anderson et al. | 137/394 |
| 3,334,684 | A | 8/1967 | Roush et al. | 165/47 |
| 3,371,298 | A | 2/1968 | Narbut | |
| 3,524,497 | A | 8/1970 | Chu et al. | |
| 3,586,101 | A | 6/1971 | Chu et al. | |
| 3,609,991 | A | 10/1971 | Chu et al. | |
| 3,731,497 | A | 5/1973 | Ewing | 62/160 |
| 3,756,903 | A | 9/1973 | Jones | |
| 3,774,677 | A | 11/1973 | Antonetti et al. | |
| 3,865,911 | A * | 2/1975 | Lefevre | 261/140.1 |
| 3,989,102 | A | 11/1976 | Jaster et al. | |

(Continued)

FOREIGN PATENT DOCUMENTS

DE GB 1220952 3/1968

(Continued)

OTHER PUBLICATIONS

Margaret Ingels, (pp. 59 and 80 of Willis Haviland Carrier "*Father of Air Conditioning*", Country Life Press—Garden City (1952).

(Continued)

*Primary Examiner* — Mohammad M Ali
(74) *Attorney, Agent, or Firm* — Baker Botts L.L.P.

(57) ABSTRACT

According to one embodiment of the disclosure, a cooling system for a heat generating structure comprises a first cooling segment and a second cooling segment. The first cooling segment and the second cooling segment each respectively comprise a cooling segment conduit and at least one cooling segment tube. The cooling segment conduits are operable to receive a fluid coolant and dispense of the fluid coolant after the fluid coolant has received thermal energy. The at least one cooling segment tubes are in thermal communication with both the cooling segment conduits and the heat generating structure. The at least one cooling segment tubes have a cooling fluid operable to transfer thermal energy from the heat generating structure to the cooling segment conduits. The cooling segment conduits transfer thermal energy from the cooling fluid to the fluid coolant. A heat transfer rate associated with the first cooling segment is substantially similar to a heat transfer rate associated with the second cooling segment.

22 Claims, 2 Drawing Sheets

U.S. PATENT DOCUMENTS 4,003,213 A 1/1977 Cox
4,019,098 A 4/1977 McCready et al.
4,072,188 A 2/1978 Wilson et al. ..... 165/80
4,129,180 A 12/1978 Larinoff
4,169,356 A 10/1979 Kingham
4,232,729 A * 11/1980 Ingram et al. ..... 165/299
4,295,341 A 10/1981 Gale
4,296,455 A 10/1981 Leaycraft et al.
4,301,861 A 11/1981 Larinoff
4,312,012 A 1/1982 Frieser et al. ..... 357/82
4,330,033 A 5/1982 Okada et al.
4,381,817 A 5/1983 Brigida et al.
4,411,756 A 10/1983 Bennett et al.
4,495,988 A 1/1985 Grossman
4,511,376 A 4/1985 Coury
4,585,054 A 4/1986 Köprunner
4,619,316 A 10/1986 Nakayama et al. ..... 165/104.33
4,638,642 A 1/1987 Tokuno
4,691,532 A 9/1987 Reid et al. ..... 62/476
4,794,984 A 1/1989 Lin
4,843,837 A 7/1989 Ogawa et al. ..... 62/324.1
4,851,856 A 7/1989 Altoz
4,938,280 A 7/1990 Clark
4,945,980 A 8/1990 Umezawa
4,998,181 A 3/1991 Haws et al.
5,021,924 A 6/1991 Kieda et al.
5,067,560 A 11/1991 Carey et al.
5,086,829 A 2/1992 Asakawa
5,128,689 A 7/1992 Wong et al.
5,148,859 A 9/1992 Beamer
5,158,136 A 10/1992 Azar
5,161,610 A 11/1992 Leidinger
5,168,919 A 12/1992 Berenholz et al.
5,181,395 A 1/1993 Carpenter et al.
5,183,104 A 2/1993 Novotny
5,239,443 A 8/1993 Fahey et al.
5,245,839 A 9/1993 Chang et al.
5,261,246 A 11/1993 Blackmon et al.
5,297,621 A 3/1994 Taraci et al. ..... 165/104.13
5,333,677 A 8/1994 Mclivadas
5,353,865 A 10/1994 Adiutori et al.
5,398,519 A 3/1995 Weber et al. ..... 62/201
5,406,807 A 4/1995 Ashiwake et al. ..... 62/376
5,447,189 A 9/1995 McIntyre
5,464,325 A 11/1995 Albring et al.
5,493,305 A 2/1996 Wooldridge et al.
5,497,631 A 3/1996 Lorentzen et al.
5,501,082 A 3/1996 Tachibana et al.
5,509,468 A 4/1996 Lopez ..... 165/144
5,515,690 A 5/1996 Blackmon et al.
5,522,452 A 6/1996 Mizuno et al.
5,536,356 A * 7/1996 Stuerzel ..... 156/514
5,605,054 A 2/1997 Chen
5,655,600 A 8/1997 Dewar et al.
5,666,269 A 9/1997 Romero et al.
5,701,751 A 12/1997 Flores
5,726,495 A 3/1998 Aihara et al. ..... 257/722
5,761,037 A 6/1998 Anderson et al.
5,815,370 A 9/1998 Sutton
5,818,692 A 10/1998 Denney, Jr. et al.
5,829,514 A 11/1998 Smith et al.
5,841,564 A 11/1998 McDunn et al.
5,862,675 A 1/1999 Scaringe et al.
5,893,270 A * 4/1999 Arph ..... 62/65
5,910,160 A 6/1999 Caakmakci et al.
5,940,270 A 8/1999 Puckett ..... 361/699
5,943,211 A 8/1999 Havey et al.
5,950,717 A 9/1999 Fay
5,960,861 A 10/1999 Price et al.
6,018,192 A 1/2000 Root et al.
6,038,873 A 3/2000 Koo ..... 62/196.4
6,052,284 A 4/2000 Suga et al.
6,052,285 A 4/2000 Hileman ..... 361/699
6,055,154 A 4/2000 Azar
6,173,758 B1 1/2001 Ward et al.
6,205,803 B1 3/2001 Scaringe ..... 62/259.2
6,220,337 B1 4/2001 Chen et al.
6,292,364 B1 9/2001 Fitzgerald et al.
6,297,775 B1 10/2001 Haws et al.
6,305,463 B1 10/2001 Salmonson
6,347,531 B1 2/2002 Roberts et al.
6,349,760 B1 2/2002 Budelman
6,366,462 B1 4/2002 Chu et al.
6,397,932 B1 6/2002 Calaman et al.
6,415,619 B1 7/2002 Bash
6,489,582 B1 12/2002 Roedl et al. ..... 219/69.17
6,498,725 B2 12/2002 Cole et al.
6,519,148 B2 2/2003 Nakagawa et al. ..... 361/679.52
6,519,955 B2 2/2003 Marsala
6,529,377 B1 3/2003 Nelson et al.
6,536,516 B2 3/2003 Davies et al.
6,571,569 B1 6/2003 Rini et al. ..... 62/259.2
6,594,479 B2 7/2003 Ammar et al.
6,603,662 B1 8/2003 Ganrot
6,604,366 B1 * 8/2003 Pflibsen ..... 62/53.2
6,625,023 B1 9/2003 Morrow et al. ..... 361/700
6,679,081 B2 1/2004 Marsala
6,687,122 B2 2/2004 Monfarad ..... 361/687
6,708,511 B2 3/2004 Martin
6,708,515 B2 3/2004 Malone et al. ..... 62/259.2
6,729,383 B1 5/2004 Cannell et al.
6,744,136 B2 6/2004 Dubhashi ..... 257/714
6,827,135 B1 12/2004 Kramer et al.
6,828,675 B2 12/2004 Memory et al. ..... 257/714
6,919,055 B2 * 7/2005 Kondo et al. ..... 422/209
6,931,834 B2 8/2005 Jones ..... 60/226.1
6,952,345 B2 10/2005 Weber et al.
6,952,346 B2 10/2005 Tilton et al.
6,957,550 B2 10/2005 Wyatt et al.
6,976,527 B2 12/2005 Kirshberg et al.
6,993,926 B2 2/2006 Rini et al. ..... 62/259.2
7,000,691 B1 2/2006 Weber
7,017,358 B2 3/2006 Wayburn et al. ..... 62/115
7,110,260 B2 9/2006 Weber et al. ..... 361/700
7,174,732 B2 * 2/2007 Taniguchi et al. ..... 62/183
7,227,753 B2 6/2007 Weber et al. ..... 361/700
7,237,404 B2 * 7/2007 Morano et al. ..... 62/434
7,240,494 B2 7/2007 Akei et al. ..... 62/3.2
7,246,658 B2 7/2007 Wyatt et al. ..... 165/274
7,254,957 B2 8/2007 Weber et al.
7,414,843 B2 8/2008 Joshi et al. ..... 361/699
7,607,475 B2 10/2009 Weber ..... 165/281
2002/0124585 A1 9/2002 Bash et al. ..... 62/228.4
2003/0042003 A1 3/2003 Novotny et al. ..... 165/47
2003/0053298 A1 3/2003 Yamada et al.
2003/0062149 A1 4/2003 Goodson et al.
2004/0231351 A1 11/2004 Wyatt
2006/0021736 A1 2/2006 Tran
2007/0230183 A1 10/2007 Shuy
2008/0158817 A1 7/2008 Tsunoda et al. ..... 361/697
2008/0291629 A1 11/2008 Ali ..... 361/700

FOREIGN PATENT DOCUMENTS

DE 201 08 088 7/2001
EP 0 243 239 A2 4/1987
EP 02 51 836 A1 5/1987
EP 0 817 263 A2 10/1991
EP 0 666 214 A1 8/1995
EP 1 143 778 A1 10/2001
EP 1380 799 A2 5/2003
EP 1 381 083 A2 1/2004
EP 1 448 040 8/2004
EP 1 601 043 11/2005
EP 1 627 192 B1 1/2008
FR 2 730 556 A1 2/1995
JP 4-316972 9/1992
WO WO 00/65890 2/2000
WO WO 02/23966 3/2002

OTHER PUBLICATIONS

Dirk Van Orshoven, "*The use of water as a refrigerant—an exploratory investigation*", Thesis University Wisconsin, 1991, pp. I, III-XIII, 1-114.

"An Integrated Thermal Architecture for Thermal Management of High Power Electronics", High Power Electronics, http:www.

coolingzone.com/Guest/News/NL_JAN_2003/Thermacore/ Thermacore Jan 2003, 22 pages.
Beaty, et al., "New Guidelines for Data Center Cooling", Dec. 2003; 8 pages.
Wilson, et al., "A Thermal Bus System for Cooling Electronic Components in High-Density Cabinets", 2004 AHSRAE Transactions; Symposia, pp. 567-573.
Center for the Analysis and Dissemination of Demonstrated Energy Technology (CADDET), Cooling plant at LEGO uses water as refrigerant, Sep. 1997.
Muller, Norbert, Ph.D. Turbo Chillers using Water as a Refrigerant, Michigan State University, AMSE Process Industry Division PID Newsletter, Fall 2002, p. 3.
Maab, Jurgen and Feddeck, Paul, BINE Projectinfo, BINE Informationsdienst, Wasser als Kaltemittel, Aug. 2003.
Kharzi, A., Ph.D., Preliminary Study of a Novel R718 Turbo-Compression Cycle using a 3-port condensing wave rotor, 2004 International ASME Turbo Exposition, ASME Paper GT2004-53622, Austria, Jun. 2004.
"Subcooled Flow Boiling With Flow Pattern Control" IBM Technical Disclosure Bulletin, vol. 22, Issue 5, pp. 1843-1844 Oct. 1, 1979.
U.S. Appl. No. 10/193,571, filed Jul. 11, 2002, entitled "Method and Apparatus for Removing Heat from a Circuit", 33 pages of text and 3 pages of drawings.
U.S. Appl. No. 10/192,891, filed Jul. 11, 2002 by inventor Richard M. Weber for "Method and Apparatus for Cooling with Coolant at a Subambient Pressure", 21 pages of text and 2 pages of drawings.
U.S. Appl. No. 10/440,716, filed May 19, 2003 by inventors William Gerald Wyatt and Richard M. Weber for "Method and Apparatus for Extracting Non-Condensable Gases in a Cooling System", 21 pages of text and 1 drawing sheet.
U.S. Appl. No. 10/853,038, filed May 25, 2004 by inventors Richard M. Weber, et al. for "Method and Apparatus for Controlling Cooling with Coolant at a Subambient Pressure" 25 pages of text and 4 drawing sheets.
U.S. Appl. No. 11/058,691, filed Feb. 15, 2005 by inventors Weber, et al., "Method and Apparatus for Cooling with Coolant at a Subambient Pressure", 28 pages.
PCT Notification of Transmittal of The International Search Report or the Declaration dated Sep. 27, 2004 for PCT/US2004/015086.
EPO Search Report dated Oct. 25, 2004 for Patent No. 03254283.9-2203; Reference No. JL3846.
EPO Search Report dated Nov. 3, 2004 for Patent No. 03254285.4-2301; Reference No. JL3847.
EP Search Report dated May 4, 2005 for European Patent Application No. EP 04256509.3.
EP Search Report dated Mar. 4, 2005 for European Patent Application No. EP 04256509.3-2220.
Notification of Transmittal of the International Search Report and the Written Opinion of the International Searching Authority or the Declaration Int'l Application No. PCT/US2005/1020544; date of mailing: Oct. 10, 2005; Int'l filing date Jun. 10, 2005; 3 pages.
"International Search Report", Int'l Application No. PCT/US2005/020544; Earliest Priority Date: Jun. 14, 2004; Int'l filing date: Jun. 10, 2005; 5 pages.
"Written Opinion of the International Searching Authority," Int'l Application No. PCT/US2005/020544; Earliest Priority Date: Jun. 14, 2004; Int'l filing date: Jun. 10, 2005; 9 pages.
Kharazi, et al., "Implementation of 3-Port Condensing Wave Rotors in R718 Cycles", Journal of Energy Resources Technology, Dec. 2006, vol. 128, pp. 325-334.
Karazi, et al. "An Application of Wave Rotor Technology for Performance Enhancement of R718 Refrigeration Cycles", The American Institute of Aeronautics and Astronautics, Inc., pp. 965-977.
Kharazi, et al., "Performance Benefits of R718 Turbo-Compression Cycle Using 3-Port Condensing Wave Rotors", Proceedings of IMECE04; 2004 ASME International Mechanical Engineering Congress and Exposition, Nov. 13-20, 2004, pp. 167-176.
Kharazi, et al., "Preliminary Study of a Novel R718 Turbo-Compression Cycle Using a 3-Port Condensing Wave Rotor", Proceedings of ASME Turbo Expo. 2004, Jun. 14-17, 2004.
Kharazi, et al., "Preliminary Study of a Novel R718 Compression Refrigeration Cycle Using a Three-Port Condensing Wave Rotor", Journal of Engineering for Gas Turbines and Power, Jul. 2005, vol. 127, pp. 539-544.
Akbari, et al., "A Review of Wave Rotor Technology and Its Applications", Proceedings of IMEC04, 2004 ASME International Mechanical Engineering Congress and Exposition, Nov. 13-20, 2004, IMECE2004-60082, pp. 81-103.
Kilicarslan, et al., "A comparative study of water as a refrigerant with some current refrigerants", International Journal of Energy Research, pp. 948-959, 2005.
Akbari, et al., "Utilizing Wave Rotor Technology to Enhance the Turbo Compression in Power and Refrigeration Cycles", Proceedings of IMECE'03, 2003 ASME International Mechanical Engineering, Nov. 16-21, 2003.
Application Bulletin #16 Water Purity Requirements in Liquid Cooling Systems, Jun. 12, 1995.
Notification of Transmittal of the International Search Report and The Written Opinion of the International Searching Authority, or the Declaration; PCT/US2007/004146; Jul. 31, 2007.
European Search Report for International Application No. PCT/US2007/008842, 9 pages.
Notification of Transmittal of the International Search Report and the Written Opinion of the International Searching Authority, or the Declaration, PCT/US2009/034609, dated Jun. 5, 2009, 14 pages.
European Patent Office Communication, dated Mar. 20, 2008, Reference JL36895P.EPP, 6 pages.
*USPTO; Office Action* for U.S. Appl. No. 11/381,297, filed May 2, 2006, in the name of Richard M. Weber; (16 pgs.), Notification Date Apr. 21, 2010.
*USPTO; Advisory Action* for U.S. Appl. No. 11/381,297, filed May 2, 2006, in the name of Richard M. Weber; (3 pgs.), Notification Date Mar. 24, 2010.
*USPTO; Final Office Action* for U.S. Appl. No. 11/381,297, filed May 2, 2006, in the name of Richard M. Weber; (16 pgs.), Notification Date Jan. 12, 2010.
*USPTO; Office Action* for U.S. Appl. No. 11/381,297, filed May 2, 2006, in the name of Richard M. Weber; (12 pgs.), Notification Date Jun. 1, 2009.
*USPTO; Office Action* for U.S. Appl. No. 11/381,297, filed May 2, 2006, in the name of Richard M. Weber; (7 pgs.), Notification Date Jan. 29, 2009.
*USPTO; Office Action* for U.S. Appl. No. 11/371,681, filed Mar. 8, 2006, in the name of William G. Wyatt; (8 pgs.), Notification Date Dec. 10, 2009.
*USPTO; Office Action* for U.S. Appl. No. 11/371,681, filed Mar. 8, 2006, in the name of William G. Wyatt; (8 pgs.), Notification Date Aug. 5, 2009.
*USPTO; Office Action* for U.S. Appl. No. 11/371,681, filed Mar. 8, 2006, in the name of William G. Wyatt; (7 pgs.), Notification Date Jun. 8, 2010.
*USPTO; Office Action* for U.S. Appl. No. 11/859,591, filed Sep. 21, 2007, in the name of William G. Wyatt; (13 pgs.), Notification Date Aug. 3, 2009.
*USPTO; Final Office Action* for U.S. Appl. No. 11/859,591, filed Sep. 21, 2007, in the name of William G. Wyatt; (13 pgs.), Notification Date Feb. 18, 2010.
*USPTO; Notice of Allowance and Fee(s) Due* for U.S. Appl. No. 11/859,591, filed Sep. 21, 2007, in the name of William G. Wyatt; (4 pgs.), Date Mailed: Jul. 8, 2010.
*USPTO; Notice of Allowance and Fee(s) Due* for U.S. Appl. No. 10/192,891, filed Jul. 11, 2002, in the name of Richard M. Weber; (6 pgs.), Date Mailed Sep. 12, 2005.
*USPTO; Office Action* for U.S. Appl. No. 10/192,891, filed Jul. 11, 2002, in the name of Richard M. Weber; (6 pgs.), Date Mailed Jan. 12, 2005.
*USPTO; Office Action* for U.S. Appl. No. 10/192,891, filed Jul. 11, 2002, in the name of Richard M. Weber; (5 pgs.), Date Mailed Mar. 4, 2004.
*USPTO; Office Action* for U.S. Appl. No. 10/192,891, filed Jul. 11, 2002, in the name of Richard M. Weber; (4 pgs.), Date Mailed Sep. 30, 2003.

*USPTO; Notice of Allowance and Fee(s) Due* for U.S. Appl. No. 10/193,571, filed Jul. 11, 2002, in the name of James L. Haws; (4 pgs.), Date Mailed Jun. 6, 2005.
*USPTO; Office Action* for U.S. Appl. No. 10/193,571, filed Jul. 11, 2002, in the name of James L. Haws; (7 pgs.), Date Mailed Feb. 1, 2005.
*USPTO; Notice of Allowance and Fee(s) Due* for U.S. Appl. No. 10/193,571, filed Jul. 11, 2002, in the name of James L. Haws; (4 pgs.), Date Mailed May 21, 2004.
*USPTO; Final Office Action* for U.S. Appl. No. 10/193,571, filed Jul. 11, 2002, in the name of James L. Haws; (8 pgs.), Date Mailed Mar. 3, 2004.
*USPTO; Office Action* for U.S. Appl. No. 10/193,571, filed Jul. 11, 2002, in the name of James L. Haws; (6 pgs.), Date Mailed Oct. 20, 2003.
*USPTO; Office Action*, U.S. Appl. No. 11/339,241, filed Jan. 24, 2006, in the name of Richard M. Weber, (10 pgs), Notification Date Oct. 9, 2007.
*USPTO; Notice of Allowance and Fees Due*, U.S. Appl. No. 11/339,241, filed Jan. 24, 2006, in the name of Richard M. Weber, (7 pgs), Notification Date Jun. 15, 2009.
*USPTO; Notice of Allowance and Fee(s) Due* for U.S. Appl No. 10/440,716, filed May 19, 2003, in the name of William Gerald Wyatt; (6 pgs.), Date Mailed Jun. 1, 2005.
*USPTO; Final Office Action* for U.S. Appl. No. 10/440,716, filed May 19, 2003, in the name of William Gerald Wyatt; (6 pgs.), Date Mailed Mar. 3, 2005.
*USPTO; Office Action* for U.S. Appl. No. 10/440,716, filed May 19, 2003, in the name of William Gerald Wyatt; (5 pgs.), Date Mailed Oct. 22, 2004.
*USPTO; Office Action* for U.S. Appl. No. 10/440,716, filed May 19, 2003, in the name of William Gerald Wyatt; (9 pgs.), Date Mailed Jun. 10, 2004.
*USPTO; Notice of Allowance and Fee(s) Due* for U.S. Appl. No. 11/058,691, filed Feb. 15, 2005, in the name of Richard Martin Weber; (5 pgs.), Date Mailed Apr. 9, 2007.
*USPTO; Office Action* for U.S. Appl. No. 11/058,691, filed Feb. 15, 2005, in the name of Richard Martin Weber; (5 pgs.), Notification Date Jan. 2, 2007.
*USPTO; Office Action* for U.S. Appl. No. 11/154,107, filed Jun. 15, 2005, in the name of Richard M. Weber; (6 pgs.), Date mailed Dec. 23, 2005.
*USPTO; Notice of Allowance and Fee(s) Due* for U.S. Appl. No. 11/154,107, filed Jun. 15, 2005, in the name of Richard M. Weber; (5 pgs.), Date Mailed May 17, 2006.
*USPTO; Notice of Allowance and Fee(s) Due* for U.S. Appl. No. 11/533,219, filed Sep. 19, 2006, in the name of Richard M. Weber; (8 pgs.), Date Mailed Jan. 31, 2007.
*USPTO; Office Action*, for U.S. Appl. No. 10/867,331, filed Jun. 14, 2004, in the name of William G. Wyatt, (10 pgs.), Notification Date Jan. 19, 2010.
*USPTO; Final Office Action*, for U.S. Appl. No. 10/867,331, in the name of William G. Wyatt, (11 pgs.), Notification Date May 17, 2010.
*European Patent Office; Communication Pursuant to Article 94(3) EPC* for Application No. 07 755 199.2-2301; Ref. JL 55728P EPP (4 pages), Jun. 10, 2010.
"Heating, Ventilating, and Air-Conditioning Applications", 1999 Ashrae Handbook, Atlanta, SI Edition, Chapter 47—Water Treatment, http://ww.ashrae.org, pp. 47.1-47.11 (12 pgs), 1999.

* cited by examiner

SYSTEM AND METHOD FOR COOLING A HEAT GENERATING STRUCTURE

TECHNICAL FIELD OF THE DISCLOSURE

This disclosure relates generally to the field of cooling systems and, more particularly, to a system and method for cooling a heat generating structure.

BACKGROUND OF THE DISCLOSURE

A variety of different types of structures can generate heat or thermal energy in operation. To prevent such structures from over heating, a variety of different types of cooling systems may be utilized to dissipate the thermal energy, including air conditioning systems.

SUMMARY OF THE DISCLOSURE

According to one embodiment of the disclosure, a cooling system for a heat generating structure comprises a first cooling segment and a second cooling segment. The first cooling segment and the second cooling segment each respectively comprise a cooling segment conduit and at least one cooling segment tube. The cooling segment conduits are operable to receive a fluid coolant and dispense of the fluid coolant after the fluid coolant has received thermal energy. The at least one cooling segment tubes are in thermal communication with both the cooling segment conduits and the heat generating structure. The at least one cooling segment tubes have a cooling fluid operable to transfer thermal energy from the heat generating structure to the cooling segment conduits. The cooling segment conduits transfer thermal energy from the cooling fluid to the fluid coolant. A heat transfer rate associated with the first cooling segment is substantially similar to a heat transfer rate associated with the second cooling segment.

Certain embodiments of the disclosure may provide numerous technical advantages. For example, a technical advantage of one embodiment may include the capability to use heat pipes over lengths that heat pipes traditionally can not be used. Other technical advantages of other embodiments may include the capability to tune a heat transfer rate associated with one set of heat pipes and a condenser to the heat transfer rate of another set of heat pipes and a condenser. Yet other technical advantages of other embodiments may include the capability to tune heat transfer rates associated with sets of heat pipes and condensers by adjusting temperatures and flow rates of fluid traveling through the condensers. Still yet other technical advantages of other embodiments may include the capability to adjust characteristics of condensers including, but not limited to, using different heat transfer pin fins and different cross sectional areas in order to tune heat transfer rates associated with sets of heat pipes and condensers.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of example embodiments of the present disclosure and its advantages, reference is now made to the following description, taken in conjunction with the accompanying drawings, in which.

DETAILED DESCRIPTION OF THE DISCLOSURE

It should be understood at the outset that although example embodiments of the present disclosure are illustrated below, the present disclosure may be implemented using any number of techniques, whether currently known or in existence. The present disclosure should in no way be limited to the example embodiments, drawings, and techniques illustrated below, including the embodiments and implementation illustrated and described herein. Additionally, the drawings are not necessarily drawn to scale.

Heat pipes are a tempting solution for applications that require low temperature gradients. Specifically, when heat pipes are well designed, such heat pipes are almost gradient-free over the length of the evaporator. Such heat pipes, however, have the disadvantage of being sensitive to orientation.

Figure 1:
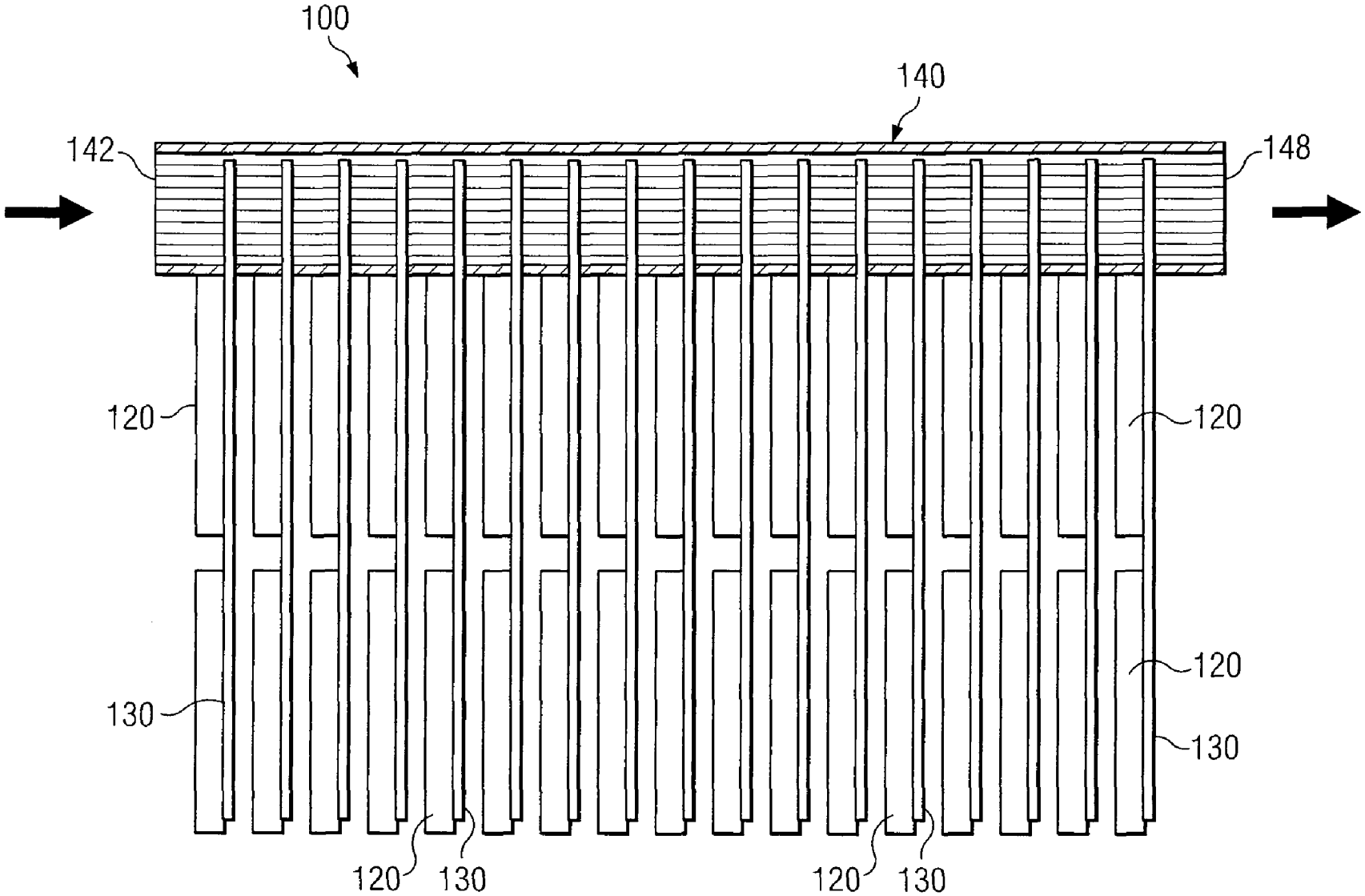
FIG. 1 shows a configuration of heat pipes that may be utilized by embodiments of the invention.

FIG. 1 shows a configuration 100 of heat pipes 130 that may be utilized by embodiments of the invention. The configuration 100 of FIG. 1 shows heat pipes 130, a heat generating structure 120, and a condenser 140. In the configuration 100, the condenser 140 is positioned on top of the heat pipes 130 and the heat generating structure 120. The heat generating structure 120 may be any of variety of devices that generate thermal energy during operation, including, but not limited to, an antenna array or other types of electronics.

As a non-limiting example of operation, similar or different fluids may be contained in the heat pipes 130 and the condenser 140. The condenser may include an inlet 142 to receive fluid and outlet 148 to dispense of fluid. As the heat generating structure 120 operates, thermal energy from the heat generating structure 120 is transferred to the heat pipes 130, for example, through a cold plate, causing the fluid in the heat pipes 130 to evaporate. Upon evaporation, the fluid in the heat pipes 130 migrates towards the condenser 140, for example, in the form of vapor. The thermal energy contained in the fluid traveling through the heat pipes 130 is transferred to the fluid in the condenser 140 and carried away, for example, through the outlet 148 of the condenser 140. Upon release of the thermal energy, the condensed fluid in the heat pipes 130 may migrate back down towards the far end of the heat pipes 130.

The configuration 100 of FIG. 1 is advantageous because it uses gravity to assist with the transport of fluid to the far end of the heat pipes 130. Notwithstanding this advantageous configuration, difficulties can arise when a length of the heat pipes 130 increase. For example, the vapor mass flow rate to remove the total heat may get too large relative to the cross-sectional area and length of the heat pipe. In such a scenario, an undesirably excessive pressure drop may occur. Accordingly, even with a heat pipe in a preferred orientation, there were be a limit to the capacity of such a heat pipe. Given this, teaching of embodiments of the invention recognize a system and method that enables the use of heat pipes over longer lengths.

Figure 2:
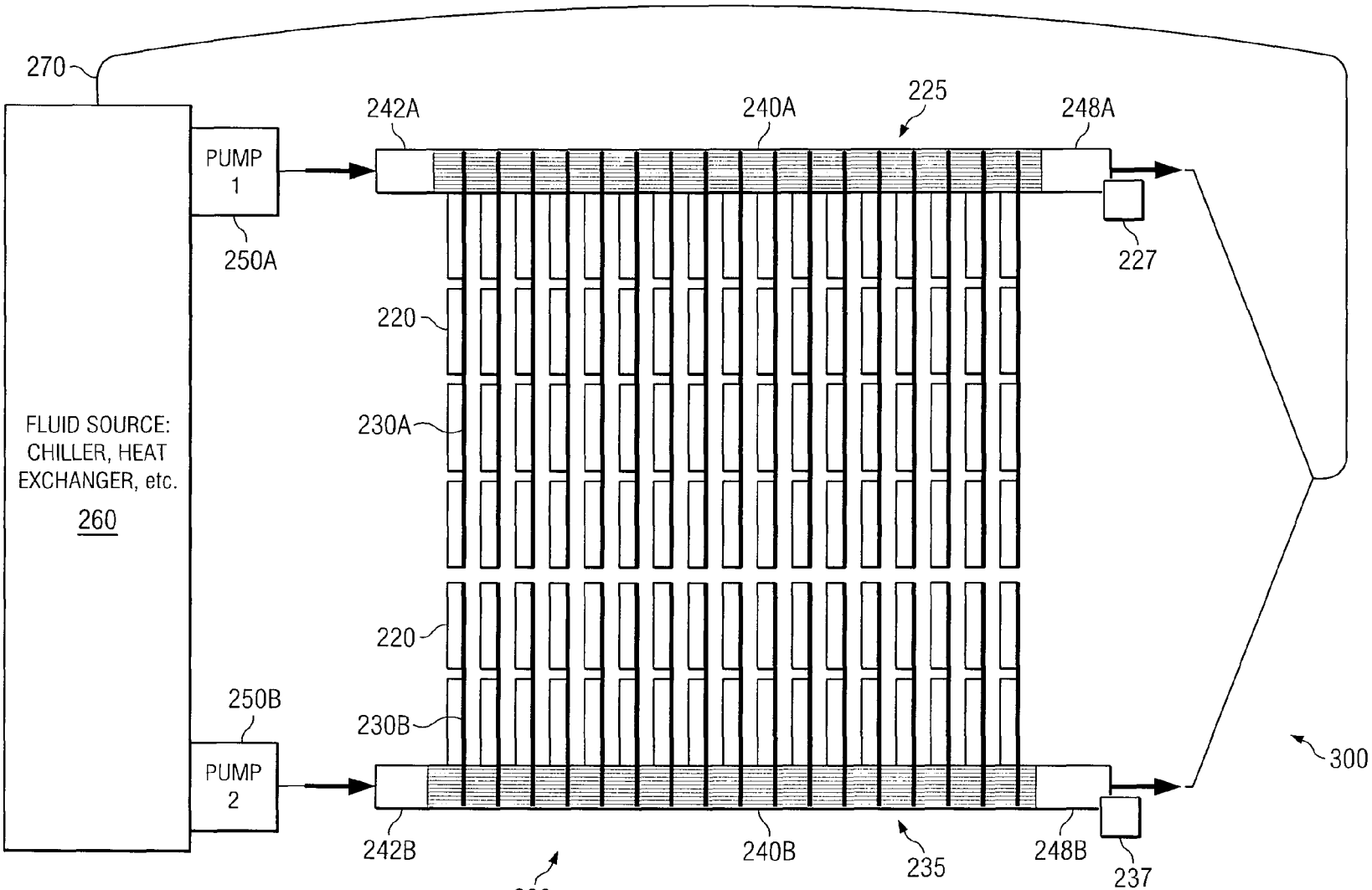
FIG. 2 shows a system, according to an embodiment of the invention.

FIG. 2 shows a system 200, according to an embodiment of the invention. The system 200 has similar features to the configuration 100 of FIG. 1 except that the system 200 includes two cooling segments 225, 235. Cooling segment 225 includes heat pipes 230A and a condenser 240A. Cooling segment 235 includes heat pipes 230B and a condenser 240B. The use of a plurality of heat pipes 230A, 230B and condensers 240A, 240B allows heat pipes to be used over a greater lengths of a heat-generating structure 220 without creating difficulties inherent to heat pipes. Specifically, each of the heat pipes 230A, 230B respectively absorb a portion of the thermal energy from the heat generating structure 220. Although two cooling segments 225, 235 are shown in the embodiment of FIG. 2, more than two cooling segments may be used in other embodiments.

As will be described further below, the cooling segments 225, 235 in particular embodiments may be part of a cooling loop 300 that include features such as a fluid source 260, pumps 250A, 250B, and a return line 270. Although a specific cooling loop 300 has been shown in FIG. 2, any of a variety of cooling loops may be used in other embodiments, including, but not limited to cooling loops that operate at subambient temperatures.

Each respective cooling segment 225, 235 may operate in a similar manner as described with reference to the configuration 100 of FIG. 1. For example, fluid may be contained in both the heat pipes 230A, 230B and the condensers 240A, 240B. The fluid in each of these four may be similar or different. Examples of fluid include, but are not limited to water or other suitable types of refrigerants or coolants.

The condensers 240A, 240B may include inlet 242A, 242B to receive fluid and outlets 248A, 248B to dispense of fluid. As the heat generating structure 220 operates, thermal energy from the heat generating structure 220 is transferred to the heat pipes 230A, 230B through any suitable thermal energy transfer mechanism, including but not limited to, a cold plate. The transfer of thermal energy causes the fluid in the heat pipes 230A, 230B to evaporate. Upon evaporation, the fluid in the heat pipes 230A, 230B migrates towards the condensers 240A, 240B, for example, in the form of vapor. The thermal energy contained in the fluid traveling through the heat pipes 230 is transferred to the fluid in the condenser 240A, 240B and carried away, for example, through the outlets 248A, 248B of the condensers 240A, 240B. Upon release of the thermal energy, the condensed fluid in the heat pipes 230A, 230B may migrate back towards the far end of the heat pipes 230A, 230B. To compensate for that fact that the heat pipes 230B are adversely oriented (for example, working against gravity in the transport to the far end of the heat pipes), heat pipes 230B are shorter than heat pipes 230A.

In operation, cooling segment 225 has different thermal operating characteristics than cooling segment 235. Specifically, according to one embodiment, cooling segment 225 has a different effective thermal conductivity or heat transfer rate than cooling segment 235. Because it desirable to uniformly cool the heat generating structure 220 (e.g., avoiding hot spots or large temperature gradients), it is desirable for the heat transfer rate of cooling segment 225 to be substantially the same as cooling segment 235. In order to make the heat pipes 230A, 230B have substantially the same heat transfer rate, a variety of techniques may be utilize to tune one or both of the cooling segments 225, 235. Examples of such tuning techniques will be described below.

As one tuning technique, the flow rate entering one or both of inlets 242A, 242B of condensers 240A, 240B may be adjusted or varied. Such an adjustment of the flow rate may be carried out, for example, in certain embodiments through modifications to a speed of a pump 250A, 250B providing fluid to each respective condenser. Other techniques may also be used to adjust the flow rate entering the condensers 240A, 240B.

As another tuning technique, the temperature of the fluid entering one or both of inlets 242A, 242B of condensers 240A, 240B may be adjusted or varied. Any of a variety of techniques may be used vary the temperature of the fluid, including changing characteristics of the fluid source 260. In particular embodiments, a mixture of different temperature fluids may be adjusted to quickly change the temperature fluid entering one or both of the inlets 242A, 242B. Additionally, in particular embodiments, fluid may enter one cooling segment 225 before the other cooling segment 235.

As yet another tuning technique, different fin stock (e.g., wavy, straight, pin, staggered, etc.) may be used in one or both of the condensers 240A, 240B. Other surface enhancement/stream changing characteristics may also be utilized, according to other embodiments.

As yet another tuning technique, the channel characteristics (e.g., width, depth) of the condensers 240A, 240B can be modified to adjust, among other things, the velocity of the fluid moving through the condenser 240A, 240B.

As yet another tuning technique, pressures associated with the fluid entering the condensers 240A, 240B may be modified to adjust a heat transfer rate of the cooling segments 225, 235.

In addition to the above specific techniques, a variety of other techniques may additionally be utilized as will become apparent after review of this specification. Furthermore, in particular embodiments, combinations of techniques may be utilized.

In particular embodiments, the adjustments or variations provided for in these techniques may be done real-time, for example, using sensors that monitor the dynamics of how the cooling segments 225, 235 are operating. As just one example, intended for illustrative purpose only, sensors 227, 237 may monitor characteristics (e.g., temperature, velocity, pressure) of fluid exiting the outlets 248A, 248B and provide dynamic feedback to other components of the cooling loop 300, for example to adjust pumps 250A, 250B, fluid source 260, channel width characteristics of condensers 240A, 240B, or other components, or combinations of the preceding. Although one example of a sensor has been shown, sensors may also located in other locations.

While this disclosure has been described in terms of certain embodiments and generally associated methods, alterations and permutations of the embodiments and methods will be apparent to those skilled in the art. Accordingly, the above description of example embodiments does not constrain this disclosure. Other changes, substitutions, and alterations are also possible without departing from the spirit and scope of this disclosure, as defined by the following claims.

What is claimed is:

1. A cooling system for a heat generating structure, the cooling system comprising:

a first cooling segment comprising:

a first cooling segment conduit operable to receive a first fluid coolant and dispense of the first fluid coolant after the first fluid coolant has received thermal energy;

at least one first cooling segment tube in thermal communication with both the first cooling segment conduit and the heat generating structure, the at least one first cooling segment tube having a first cooling fluid operable to transfer thermal energy from the heat generating structure to the first cooling segment conduit, the first cooling segment conduit operable to transfer thermal energy from the first cooling fluid to the first fluid coolant;

a second cooling segment comprising:

a second cooling segment conduit operable to receive a second fluid coolant and dispense of the second fluid coolant after the second fluid coolant has received thermal energy;

at least one second cooling segment tube in thermal communication with both the second cooling segment conduit and the heat generating structure, the at least one second cooling segment tube having a second cooling fluid operable to transfer thermal energy from the heat generating structure to the second cooling segment conduit, the second cooling segment conduit operable to transfer thermal energy from the second cooling fluid to the second fluid coolant; and at least one sensor operable to measure a characteristic of at least one of the first cooling segment or the second cooling segment, the sensor providing dynamic feedback to a component of the cooling system to maintain a heat transfer rate of at least one of the first cooling segment or the second cooling segment, wherein a heat transfer rate associated with the first cooling segment is substantially similar to a heat transfer rate associated with the second cooling segment.

2. The cooling system of claim 1, wherein the at least one first cooling segment tube is a plurality of first cooling segment tubes and the at least one second cooling segment tube is a plurality of second cooling segment tubes.

3. The cooling system of claim 2, wherein:

the first cooling segment conduit is vertically positioned above the plurality of first cooling segment tubes;

the second cooling segment conduit is vertically positioned below the plurality of second cooling segment tubes; and the plurality of first cooling segment tubes are longer than the plurality of second cooling segment tubes.

4. The cooling system of claim 1, wherein the heat transfer rate associated with the first cooling segment and the heat transfer rate associated with the second cooling segment are at least partially maintained at a substantially similar level by controlling at least one of the flow rate of the first fluid coolant through the first cooling segment conduit or the flow rate of the second fluid coolant through the second cooling segment conduit.

5. The cooling system of claim 4, wherein the flow rate of the first fluid coolant through the first cooling segment conduit or the second fluid coolant through the second cooling segment conduit is controlled in part by varying the cross-sectional area of the first cooling segment conduit or the second cooling segment conduit.

6. The cooling system of claim 4, wherein:

the flow rate of the first fluid coolant through the first cooling segment conduit is controlled in part by a first pump associated with the first cooling segment; and the flow rate of the second fluid coolant through the second cooling segment conduit is controlled in part by a second pump associated with the second cooling segment.

7. The cooling system of claim 4, wherein the flow rate of the first fluid coolant through the first cooling segment conduit is different than the flow rate of the second fluid coolant through the second cooling segment conduit.

8. The cooling system of claim 1, wherein the heat transfer rate associated with the first cooling segment and the heat transfer rate associated with the second cooling segment are at least partially maintained at a substantially similar level by controlling at least one of the temperature of the first fluid coolant entering the first cooling segment conduit or the temperature of the second fluid coolant entering the second cooling segment conduit.

9. The cooling system of claim 1, wherein the first fluid coolant and the second fluid coolant are the same fluid, and the first fluid coolant is directed through the first cooling segment conduit prior to directing the flow of the second fluid coolant through the second cooling segment conduit.

10. The cooling system of claim 1, wherein the heat transfer rate associated with the first cooling segment and the heat transfer rate associated with the second cooling segment are maintained at a substantially similar level by using different heat transfer pin fins in each of the first cooling segments and the second cooling segments.

11. The cooling system of claim 1, wherein the dynamic feedback initiates a change of at least one of a temperature, pressure, or flow rate of at least one of the first fluid coolant in the first cooling segment conduit or the second fluid coolant in the second cooling segment conduit.

12. A method for cooling a heat generating structure comprising:

directing a first fluid coolant through a first cooling segment and a second fluid coolant through a second cooling segment, wherein:

the first cooling segment comprises:

a first cooling segment conduit operable to receive the first fluid coolant and dispense of the first fluid coolant after the first fluid coolant has received thermal energy, and at least one first cooling segment tube in thermal communication with both the first cooling segment conduit and the heat generating structure, the at least one first cooling segment tube having a first cooling fluid operable to transfer thermal energy from the heat generating structure to the first cooling segment conduit, the first cooling segment conduit operable to transfer thermal energy from the first cooling fluid to the first fluid coolant; and the second cooling segment comprises:

a second cooling segment conduit operable to receive the second fluid coolant and dispense of the second fluid coolant after the second fluid coolant has received thermal energy;

at least one second cooling segment tube in thermal communication with both the second cooling segment conduit and the heat generating structure, the at least one second cooling segment tube having a second cooling fluid operable to transfer thermal energy from the heat generating structure to the second cooling segment conduit, the second cooling segment conduit operable to transfer thermal energy from the second cooling fluid to the second fluid coolant;

monitoring, with at least one sensor, a characteristic of at least one of the first cooling segment or the second cooling segment;

providing dynamic feedback to a component of the cooling system to maintain the heat transfer rate of at least one of the first cooling segment or the second cooling segment; and maintaining a heat transfer rate associated with the first cooling segment at a level that is substantially similar to a heat transfer rate associated with the second cooling segment.

13. The method structure of claim 12, wherein:

the at least one first cooling segment tube is a plurality of first cooling segment tubes and the at least one second cooling segment tube is a plurality of second cooling segment tubes;

the first cooling segment conduit is vertically positioned above the plurality of first cooling segment tubes;

the second cooling segment conduit is vertically positioned below the plurality of second cooling segment tubes; and the plurality of first cooling segment tubes are longer than the plurality of second cooling segment tubes.

14. The method of claim 12, wherein at least a portion of maintaining the heat transfer rate associated with the first cooling segment at a level substantially similar to the heat transfer rate associated with the second cooling segment comprises controlling at least one of the flow rate of the first fluid coolant through the first cooling segment conduit or the flow rate of the second fluid coolant through the second cooling segment conduit.

15. The method of claim 14, wherein the flow rate of the first fluid coolant through the first cooling segment conduit or the second fluid coolant through the second cooling segment conduit is controlled in part by varying the cross-sectional area of the first cooling segment conduit or the second cooling segment conduit.

16. The method of claim 14, wherein:

the flow rate of the first fluid coolant through the first cooling segment conduit is controlled in part by a first pump associated with the first cooling segment; and the flow rate of the second fluid coolant through the second cooling segment conduit is controlled in part by a second pump associated with the second cooling segment.

17. The method of claim 12, wherein at least a portion of maintaining the heat transfer rate associated with the first cooling segment at a level substantially similar to the heat transfer rate associated with the second cooling segment comprises controlling at least one of the temperature of the first fluid coolant entering the first cooling segment conduit or the temperature of the second fluid coolant entering the second cooling segment conduit.

18. The method of claim 12, wherein the first fluid coolant and the second fluid coolant are the same fluid, and the first fluid coolant is directed through the first cooling segment conduit prior to directing the flow of the second fluid coolant through the second cooling segment conduit.

19. The method of claim 12, wherein at least a portion of maintaining the heat transfer rate associated with the first cooling segment at a level substantially similar to the heat transfer rate associated with the second cooling segment comprises using different heat transfer pin fins in each of the first cooling segments and the second cooling segments.

20. The method of claim 12, further comprising:

in response to the dynamic feedback, initiating a change of at least one of a temperature, pressure, or flow rate of at least one of the first fluid coolant in the first cooling segment conduit or the second fluid coolant in the second cooling segment conduit.

21. A cooling system for a heat generating structure, the cooling system comprising:

a first cooling segment comprising:

a first condenser operable to receive a first fluid coolant and dispense of the first fluid coolant after the first fluid coolant has received thermal energy;

at least one first heat pipe in thermal communication with both the first condenser and the heat generating structure, the at least one first heat pipe having a first cooling fluid operable to transfer thermal energy from the heat generating structure to the first condenser, the first condenser operable to transfer thermal energy from the first cooling fluid to the first fluid coolant;

a second cooling segment comprising:

a second condenser operable to receive a second fluid coolant and dispense of the second fluid coolant after the second fluid coolant has received thermal energy;

at least one second heat pipe in thermal communication with both the second condenser and the heat generating structure, the at least one second heat pipe having a second cooling fluid operable to transfer thermal energy from the heat generating structure to the second condenser, the second condenser operable to transfer thermal energy from the second cooling fluid to the second fluid coolant; and at least one sensor operable to measure a characteristic of at least one of the first cooling segment or the second cooling segment, the sensor providing dynamic feedback to a component of the cooling system to maintain a heat transfer rate of at least one of the first heat pipe or the second heat pipe, wherein a heat transfer rate associated with the first heat pipe is substantially similar to a heat transfer rate associated with the second cooling segment.

22. The cooling system of claim 21, further comprising:

a first cooling segment comprising:

the at least one first heat pipe is a plurality of first heat pipes and the at least one second heat pipe is a plurality of second heat pipes;

the first condenser is vertically positioned above the plurality of first heat pipes;

the second condenser is vertically positioned below the plurality of second heat pipes; and the plurality of first heat pipes are longer than the plurality of second heat pipes.

* * * * *